US006561794B1

(12) United States Patent
Narasimhan

(10) Patent No.: US 6,561,794 B1
(45) Date of Patent: May 13, 2003

(54) INFRARED HEATER

(75) Inventor: Dave Narasimhan, Flemington, NJ (US)

(73) Assignee: Honeywell ASCa Inc., North Vancouver (CA)

( * ) Notice: Subject to any disclaimer, the term of this patent is extended or adjusted under 35 U.S.C. 154(b) by 45 days.

(21) Appl. No.: 09/775,391

(22) Filed: Jan. 31, 2001

Related U.S. Application Data

(63) Continuation-in-part of application No. 09/557,093, filed on Apr. 21, 2000.

(51) Int. Cl.[7] ..... F23D 14/16
(52) U.S. Cl. ..... 431/328; 277/645; 277/647
(58) Field of Search ..... 431/326, 328; 277/645, 943, 647, 644, 630

(56) References Cited

U.S. PATENT DOCUMENTS

| | | | | | |
|---|---|---|---|---|---|
| 3,407,024 | A | | 10/1968 | Hirschberg et al. | 431/328 |
| 3,554,567 | A | | 1/1971 | Carroll et al. | 277/164 |
| 4,121,843 | A | | 10/1978 | Halling | 277/200 |
| 4,189,297 | A | | 2/1980 | Bratko et al. | 431/328 |
| 4,255,123 | A | | 3/1981 | Bishilany, III et al. | 431/328 |
| 4,326,843 | A | * | 4/1982 | Smith | 431/328 |
| 4,437,833 | A | | 3/1984 | Mertz | 431/329 |
| 4,654,000 | A | | 3/1987 | Smith | 431/328 |
| 4,662,349 | A | | 5/1987 | McKenzie et al. | 126/41 R |
| 5,593,300 | A | | 1/1997 | de Gouville | 431/328 |
| 5,651,554 | A | | 7/1997 | Townsend | 277/235 |
| 6,030,206 | A | * | 2/2000 | Shizukuisha et al. | 431/328 |
| 6,045,355 | A | | 4/2000 | Chapman et al. | 431/329 |

FOREIGN PATENT DOCUMENTS

| | | |
|---|---|---|
| BE | 1008172 | 2/1996 |
| DE | 295 20 108 | 5/1997 |
| DE | 295 20 109 | 5/1997 |

OTHER PUBLICATIONS

English Translation of Belgium Publication 1008172 A3.*
English Translation of German Publication 29520108 U1.*
English Translation of German Publication 29520109 U1.*
International Search Report dated Sep. 5, 2001 corresponding to International Application PCT/CA 01/00557.
Smith, "Heat transfer dynamics", Tappi Journal, vol. 77, No. 8, Aug. 1994, pp 239–245.
Brochure entitled "InfraZone—Gas Infrared System for Advanced Coating Control", Measurex Devron.

* cited by examiner

*Primary Examiner*—Sara Clarke
(74) *Attorney, Agent, or Firm*—Christie, Parker & Hale, LLP

(57) ABSTRACT

An infrared heating unit which finds particular application in paper making equipment for coating drying and moisture profile control. In one embodiment, the heating unit comprises a housing and a heat resistant, porous ceramic matrix received in the housing having an inner surface, side walls and an external surface. The inner surface of the ceramic matrix and the housing cooperate to define a chamber. There is at least one resilient anchoring strip extending between the ceramic matrix and the housing about the perimeter of the ceramic matrix to retain the ceramic matrix in place within the housing and seal the edges of the ceramic matrix. An inlet to the housing is provided to admit a gas/air combustion mixture to the chamber. The gas/air mixture passes through the ceramic matrix to burn adjacent the external surface of the ceramic matrix to heat the external surface to incandescence. The resilient anchoring strip is adapted to expand or contract to accommodate relative movement of the ceramic matrix with respect to the housing due to heating expansion of the housing. In another embodiment, the edge of the ceramic matrix is sealed with a blocking agent to prevent flame propagation from the external surface of the matrix to the side walls, and a heat resistant layer is provided between the ceramic matrix and the housing to limit heat distribution to the housing and thereby thermal expansion of the housing.

34 Claims, 6 Drawing Sheets

INFRARED HEATER

CROSS-REFERENCE TO RELATED APPLICATIONS

This application is a continuation-in-part of, and claims the benefit of priority from U.S. patent application Ser. No. 09/557,093, filed on Apr. 21, 2000.

FIELD OF THE INVENTION

This invention relates to heating apparatus for treating a web of material, and, more particularly, to an infrared (IR) heater for heating a paper web.

BACKGROUND OF THE INVENTION

Conventional papermaking machinery for producing a continuous sheet of paper includes equipment to set the sheet properties of the paper as it is being manufactured. One of the more basic operations on a paper machine is control of the cross-direction moisture profile by drying with gas infrared heaters. Such heaters are also useful for drying coatings onto a paper web.

Typical infrared heating systems designed specifically for papermaking machinery comprise a series of independently controllable heater units or emitters that are positioned over the paper web in the cross-machine direction CD. Each heater unit consists of a porous refractory ceramic matrix that is fitted into a metallic housing. A plurality of housings are positioned side by side to extend across the web. The porous ceramic matrix is bonded to an aluminum housing with silicone to define a plenum chamber. The plenum chamber of the housing is supplied with an air/fuel mixture via an inlet that connects to a fuel supply. Gaseous fuel in the form of natural gas or propane is mixed with air in a 1:10 ratio to create the air/fuel mixture. Combustion occurs only on the outer 1 mm of the ceramic matrix to provide fast heat up times of about 5 seconds and fast cool down times of about one second. This behavior is essentially due to the ability of the infrared emitting particles incorporated in the matrix to radiate the heat generated, thus preventing the combustion flames.from destroying the matrix by melting. However, if the emitting particles cannot radiate the heat energy, for example in a crack in the matrix or at the edges between the matrix and the housing, the flame can melt the matrix and propagate due to the open porosity of the matrix. Any such propagating flame will eventually reaching the plenum chamber of the unit creating an explosion. Applicant's co-pending U.S. patent application Ser. No. 09/638,731 filed Aug. 14, 2000 entitled INFRARED HEATER WITH IMPROVED MATRIX discloses an improved crack resistant matrix, the disclosure of which is incorporated herein by reference.

During normal operation, the temperature of the heater will be about 40° C. at the inner surface of the ceramic matrix to between 575° C. to 950° C. at the exterior surface of the matrix adjacent where combustion occurs. Due to the high thermal output of the heater unit, the ambient temperature can exceed 150° C. At this temperature, thermal expansion of the metal housing having a typical wall length of 400 mm can result in over 1.5 mm expansion of the housing with respect to the ceramic matrix. While the exterior matrix surface operates at much higher temperatures, the overall matrix tends to stay relatively cool due to its low thermal conductivity and flame quenching characteristics. The ceramic matrix tends not to expand and may even contract after prolonged use. Expansion of the housing and nonexpansion or even contraction of the ceramic matrix tends to stretch and fray the edges of the ceramic matrix material. Repeated heating and cooling results in progressive fraying of the edges of the matrix where it is attached to the frame to create tiny cavities. When the exterior surface combustion flame enters a cavity, it can ignite the gas in the housing resulting in an explosion. Also, the frayed edges of the matrix are more porous and are prone to initiation of flame propagation into the matrix as well as thermal damage to the silicone bond layer as described below.

In addition, in prior art heating unit designs, the ceramic matrix is bonded to the metal housing using an elastomer such as silicone glue. Silicone glue does not seal the ceramic matrix, and it is possible for the gas/air mixture to leak at the side walls adjacent the glue. A cold wall of the housing can arrest the flame propagation from the surface if the wall is in close proximity to the flame front. If the silicone layer is sufficiently thick (~1 mm), the housing wall tends not to quench the propagating flame front by heat extraction and the flame can enter the plenum chamber igniting the fuel air mixture. Thus, the combustion flame on the external surface of the matrix can propagate to the elastomer bond region and burn, exposing new surfaces on the side wall of the ceramic matrix with access to the gas/air mixture. This leads to disintegration of the bond between the ceramic matrix and the metal housing to allow the flame to ignite the gas in the housing resulting in the same type of explosion described above.

There is therefore a need to develop an infrared burner unit that avoids the thermal expansion/contraction degradation of the ceramic matrix over time and the flame propagation problems of the prior art.

SUMMARY OF THE INVENTION

To address the foregoing problems, applicant has developed a new infrared heater, which is constructed so as to minimize the effects of heat expansion of the metal housing.

In one embodiment, this involves providing a flexible sealing member about the perimeter of the ceramic matrix to join the matrix to the housing that is capable of tolerating the differential expansion. This embodiment finds particular application when the housing operating temperature is high (>150 C). Such a heating unit comprises:

- a housing;
- a heat resistant, porous ceramic matrix received in the housing having an inner surface, side walls and an external surface, the inner surface of the ceramic matrix and the housing cooperating to define a chamber;
- at least one resilient anchoring strip extending between the ceramic matrix and the housing about the perimeter of the ceramic matrix to retain the ceramic matrix in place within the housing and seal the edges of the ceramic matrix; and
- an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

Preferably, the side walls of the porous ceramic matrix adjacent the at least one resilient anchoring strip are blocked with a blocking agent to prevent flow of the gas/air combustion mixture through the side walls. This ensures that flames on the external surface of the matrix are not able to migrate about the side walls of the matrix to damage or consume the resilient anchoring strip.

In another embodiment, the resilient anchoring strip is not used and the edge of the ceramic matrix is blocked with a blocking agent to prevent flame propagation from the external surface of the matrix to the side walls. In this arrangement, the heating unit comprises:

a housing;

a heat resistant, porous ceramic matrix received in the housing having an inner surface, side walls and an external surface;

a blocking layer to block the side walls of the porous ceramic matrix to prevent flow of a gas/air combustion mixture through the side walls;

an adhesive layer between the housing and the side walls of the ceramic matrix to retain the matrix within the housing, the inner surface of the ceramic matrix and the housing cooperating to define a chamber; and an inlet to the housing to admit the gas/air combustion mixture to the chamber whereby the gas/air mixture passes through the ceramic matrix to burn adjacent the external surface of the ceramic matrix to heat the external surface.

This heating unit is most useful when the housing temperature is maintained below 180 C and preferably below 150 C by using auxiliary air flow cooling or by incorporation of an insulating medium covering the free edges of the housing which gather most of the reflected infrared radiation. Preferably, the insulating medium is a heat resistant insulating layer provided between the ceramic matrix and the housing to limit heat availability to the housing and thereby thermal expansion of the housing.

In a still further embodiment, the problem of differential thermal expansion of the housing and the ceramic matrix is substantially avoided by eliminating the housing surrounding the ceramic matrix. Instead, the sealed side walls of the ceramic matrix are exposed well above the housing side walls. In this arrangement, the heating unit comprises:

a lower housing having an inlet to admit a gas/air combustion mixture;

a heat resistant, upper porous ceramic matrix having an inner surface, an external surface and blocked side walls, the ceramic matrix being mounted atop the lower housing such that the blocked side walls of the matrix are exposed and the inner surface of the ceramic matrix and the housing cooperate to define a chamber to receive the gas/air combustion mixture;

whereby the gas/air mixture passes through the ceramic matrix to burn adjacent the external surface of the ceramic matrix to heat the external surface, and the blocked side walls prevent flow of the gas/air combustion mixture through the side walls.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
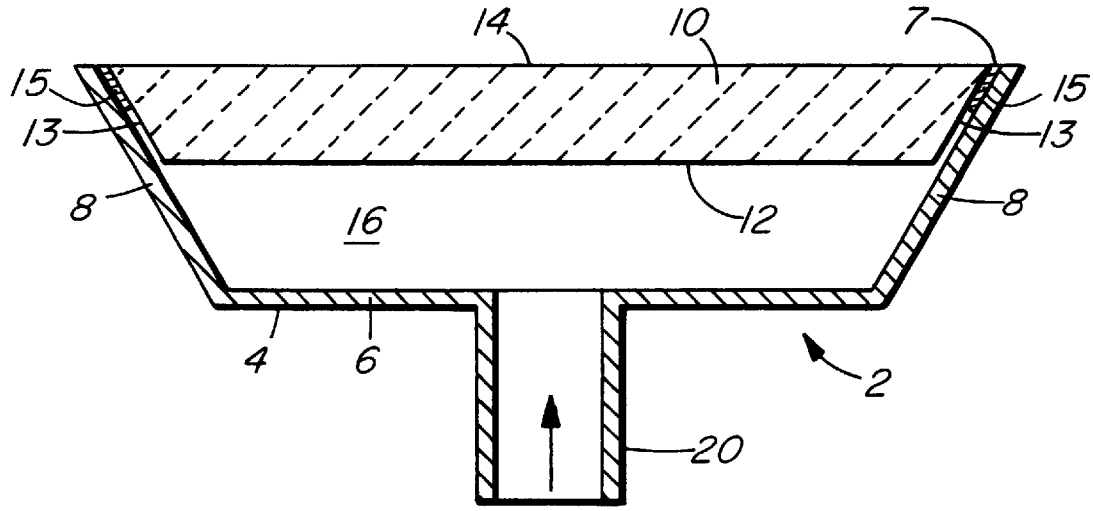
FIG. 1 PRIOR ART
FIG. 1 is a schematic cross-section through a prior art heating unit.

Referring to FIG. 1, there is shown schematically in cross-section a typical prior art gas infrared heating unit or emitter 2. A metallic housing formed from a metal such as aluminum defines a frame 4 having a back wall 6 and four side walls 8. The side walls terminate at a front opening 7 in the frame. A porous refractory ceramic matrix 10 of conventional manufacture is formed into a block that substantially corresponds in shape and size to the opening 7 of the frame. The typical structure and composition of the ceramic matrix material is well known to a person skilled in the art. An example of a typical ceramic matrix material is disclosed in U.S. Pat. No. 4,654,000 to Smith. The block of ceramic matrix 10 has an inner surface 12, side walls 13 and an external surface 14 opposite inner surface 12. The block is inserted into frame 4 such that inner surface 12 is spaced apart from back wall 6 of the frame. The side walls 13 of the block of ceramic matrix are bonded by silicone glue to the adjacent side walls 8 of frame 4 to retain the block in place within the housing. A chamber 16 is defined between the back wall 6 of frame 4 and the inner surface 12 of the ceramic matrix.

There is an inlet 20 through frame 4 into chamber 16 to admit an air/fuel mixture to the chamber. The fuel is typically natural gas or propane and is mixed with air in a conventional manner in a ratio of approximately 1:10 to create a combustion mixture. The combustion mixture passes through the porous ceramic matrix to burn adjacent the external surface 14 of the ceramic matrix to heat the external surface to incandescence to provide heat energy for drying of the paper web. Infrared radiation is emitted by infrared emitting high emmisivity particles (for example silicon carbide) incorporated in the matrix.

The above structure for a heating unit is known and suffers from the disadvantage previously described, namely, over time, the side walls of the ceramic matrix tend to be stretched due to thermal expansion of the frame 4 with respect to the ceramic matrix 10 which leads to the formation of cavities. A second mode of failure is the propagation of flames through the side walls of the matrix. This arises due to the internal porosity of the matrix which allows the combustion flames to move from the external surface 14 to the side walls 13 of the matrix.

Figure 2:
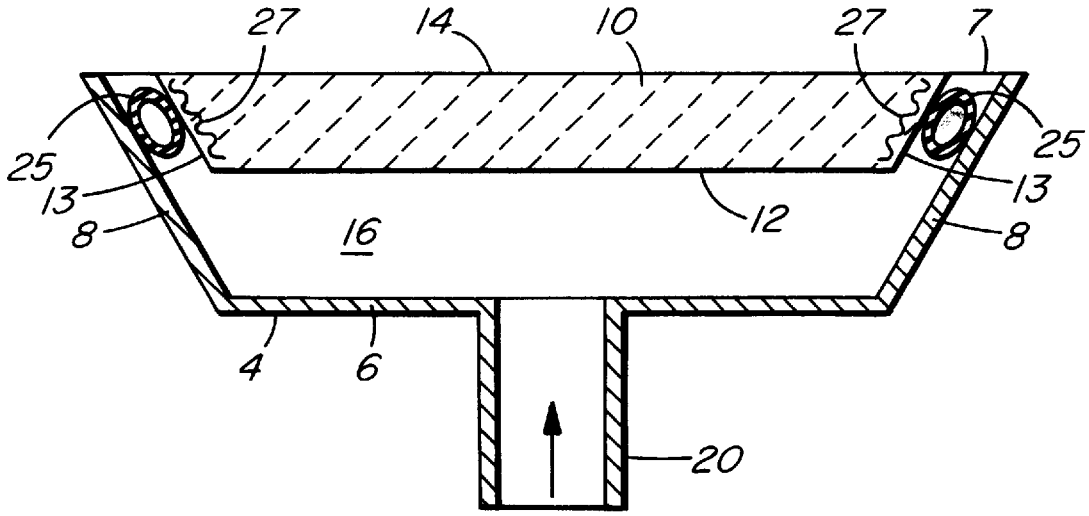
FIG. 2 is a schematic cross-section through a heating unit according to a first embodiment of the present invention prior to heating.

FIG. 2 shows schematically in cross-section an improved heating unit according to a first embodiment of the present invention. Parts that are identical to the parts of FIG. 1 are labeled with the same reference numbers. Instead of the side walls 13 of ceramic matrix 10 being bonded directly the side walls 8 of the frame 4, a resilient anchoring strip in the form of a silicone tube 25 extends between the ceramic matrix and the housing side walls about the perimeter of the ceramic matrix. In the embodiment of FIG. 2, the tube 25 is hollow and of circular cross-section and acts to retain the ceramic matrix 10 in place within frame 4 and also to seal the edges of the ceramic matrix to seal chamber 16. A silicone glue is preferably used to attach tube 25 to the frame side walls 8 and the ceramic matrix side walls 13.

Figure 3A:
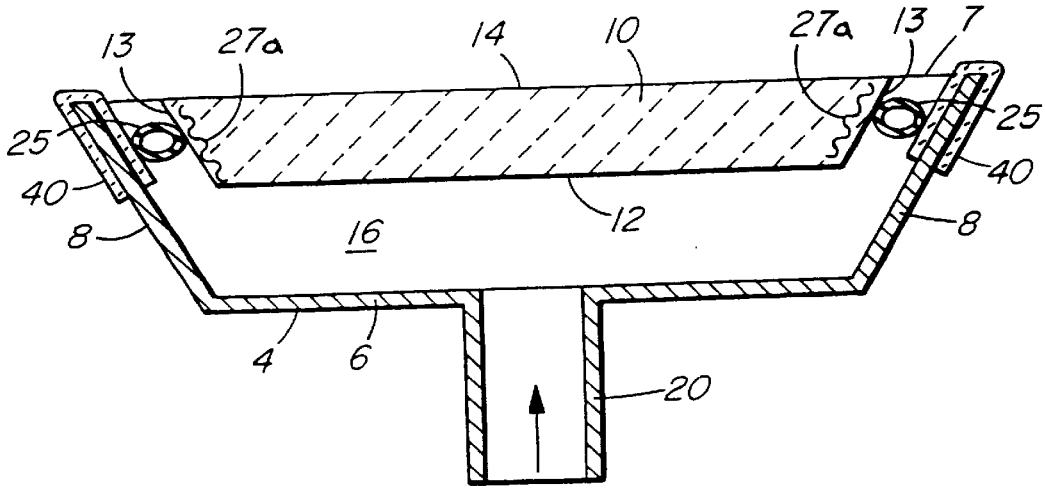
FIG. 3A is a schematic cross-section through the heating unit of FIG. 2A when in a thermally expanded state.
Figure 3:
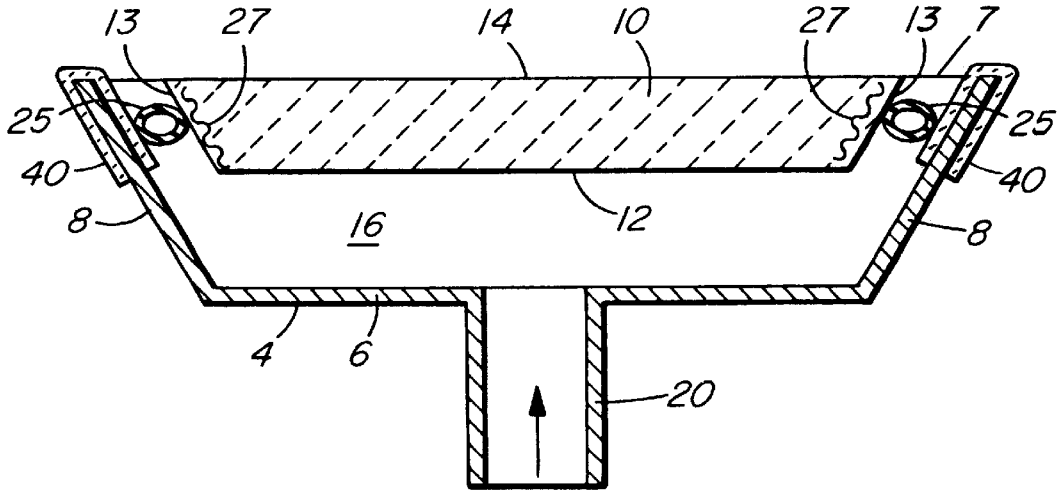
FIG. 3 is a schematic cross-section through the heating unit of FIG. 2 when in a thermally expanded state.

As shown in FIG. 2, ceramic matrix 10 is dimensioned to fit within opening 7 of frame 4 such that there is a gap to accommodate tube 25. Preferably, in an unheated state, tube 25 is deformed into an oval cross-section with its major axis parallel to frame side walls 8. FIG. 3 shows the heating unit of FIG. 2 after heating has occurred and frame 4 has expanded with respect to ceramic matrix 10. The thermal expansion of frame 4 progressively changes the cross-section of tube 25 to its default circular configuration and then to an oval configuration in which the major axis is perpendicular to frame side walls 8. Tube 25 acts to expand or contract to accommodate relative movement of the ceramic matrix with respect to the frame while maintaining a seal about ceramic matrix. Because tube 25 stretches, the stretching forces acting directly on the edges 13 of the ceramic matrix are significantly reduced which tends to reduce fraying of the edges of the ceramic matrix.

In prototype testing, silicone tubes of circular cross-section were selected having the following dimensions:

| | Test 1 | Test 2 |
|---|---|---|
| Outside diameter: | 7/32inch | 0.183 inch |
| Inside diameter: | 3/32inch | 0.132 inch |
| Wall thickness: | 1/16inch | 0.026 inch |

A block of ceramic matrix was machined to a dimension of 3/16 inch smaller than the frame to accommodate a tube. Each tube wound about the perimeter of the ceramic matrix and glued into place between the side walls of the frame and the ceramic matrix was able to accommodate a displacement of over 2 mm between the frame side walls and the ceramic matrix by deformation of the tube alone. Additional, expansion is available due to elastic stretching of the tube.

In prototype testing of the heating unit of the present invention, it was observed that in some cases, the high temperature flame at the external surface 14 of the ceramic matrix would migrate to the side walls of the matrix and begin to burn and consume tube 25, particularly when an epoxy layer blocking the side walls of the matrix did not penetrate well enough into the matrix to achieve the desired sealing effect. If left unchecked, the destruction of tube 25 would allow the flame of the external surface to propagate to the internal chamber 16. This could lead to ignition of the gas/air mixture in chamber 16 and potentially explosive destruction of the heating unit.

Further investigation of this flame propagation phenomenon indicated that combustion flames on the external surface 14 of the ceramic matrix can migrate to the side walls due to gas/air combustion mixture flowing through the side walls. As mentioned previously, combustion tends to occur in the very outer 1 mm layer of the external surface of the ceramic matrix due to the presence of infrared emitting particles. If gas/air combustion mixture is able to flow freely to the side walls of the matrix through the internal pores of the matrix, the combustion mixture will tend to sustain any flames that may propagate at the side walls, due to the burning regions inability to radiate the heat by infrared emission. This may eventually lead to destruction of tube 25. To prevent the possibility of gas/air mixture flowing through the side walls, it is recommended that the side walls of the matrix be sealed with a blocking agent 27.

In subsequent testing, it was determined that to be effective at sealing the side walls, the blocking agent 27 must penetrate and seal the side walls to a depth of at least about 2 mm. This depth is greater than the usual combustion zone depth of 1 mm on the outer surface of the ceramic matrix. It was determined that the best candidates for the blocking agent 27 were materials that are able to wet and penetrate the ceramic matrix and harden without formation of volatile matter. Evolution of volatile matter produces porous regions that permit flow of the gas/air combustion mixture. Suitable blocking agents include thermosetting materials, for example, epoxies, which harden by dross linking of molecular bonds to form a sealing layer. Materials such as polyesters and polyurethane also serve to effectively seal the side walls of the ceramic matrix. Also suitable are meltable materials than can penetrate the side wall of the ceramic matrix and solidify. The internal temperature of the ceramic matrix generally does not exceed 150 degrees Celsius, and the blocking agent 27 must be capable of maintaining a seal at this relatively low temperature.

A further suitable blocking agent 27 is a dilute solution of sodium silicate applied to the side walls of the ceramic matrix. The sodium silicate solution is applied to the side walls to penetrate to a depth of at least 2 mm. By chemical reaction, the sodium silicate and carbon dioxide form silica and sodium carbonate and the silica blocks the pores of the ceramic matrix. Since water is evaporated, some porosity is always present in this blocked layer. Beyond a critical concentration of sodium silicate, a nearly continuous blocked matrix is produced. Therefore, a solution of sodium silicate is best used as an on-site repair technique in the event that leakage of air/fuel through the side walls of ceramic matrix is detected. The site of leakage is noted, the heater unit shut off and a solution of sodium silicate applied to the region and allowed to dry to seal the region. Use of sodium silicate solution is not recommended for initial blocking of the side walls of the ceramic matrix for the reasons mentioned above.

Figure 2A:
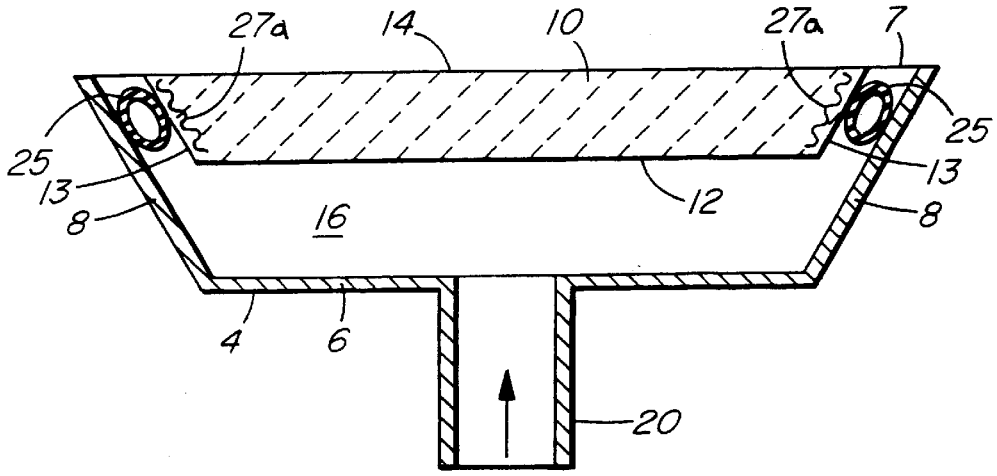
FIG. 2A is a schematic cross-section through a heating unit according to another embodiment of the present invention prior to heating.

The presence of the blocking agent 27 also serves to mechanically strengthen side walls 13. Since tube 25 still applies a reduced load directly to the side walls 13 of the ceramic matrix 10, it is preferable for the side walls to be reinforced to further minimize fraying. Tube 25 can be bonded directly to the exposed blocking agent 27. If a blocking agent 27 is not used, the side walls 13 can be strengthened by coating the side walls with a reinforcing material 27*a* and bonding the tube to the reinforcing material 27*a*, as shown in FIGS. 2A and 3A. For example, bonding a sheet of low thermal expansion rigid material to the side wall with silicone glue will reinforce the side wall. An appropriate rigid material is glass reinforced phenolic or epoxy resin. This approach redistribute the load applied by tube 25 over the full side wall of the ceramic matrix to further reduce fraying. However, the risk of flame propagation to the sides has to be addressed.

Figure 4:
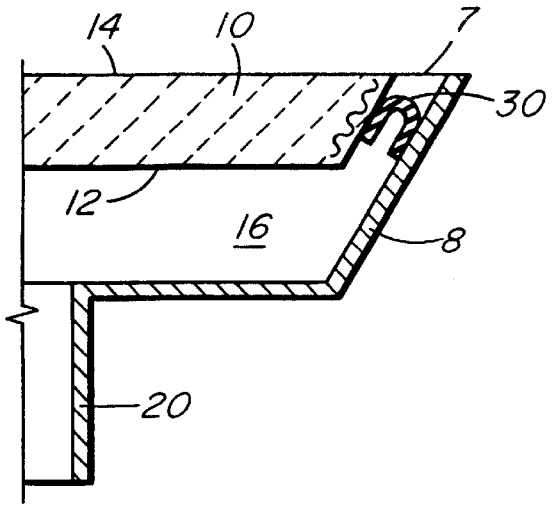
FIG. 4 is a schematic cross-section through a second embodiment of the heating unit that uses U-shaped resilient anchoring strips to locate the ceramic matrix within the heating unit frame.

FIG. 4 shows an alternative embodiment of the heating unit of the present invention in which the resilient anchoring strip is a silicone strip 30 of generally U-shaped cross-section. The generally vertical arms of the U are bonded by silicone glue to the side walls of the frame and the ceramic matrix. It will be readily apparent to those skilled in the art that other cross-sectional configurations of the resilient anchoring strip are possible. Open shapes or closed tubular shapes which stretch to accommodate thermal expansion of the frame side walls are also possible.

Figure 5A:
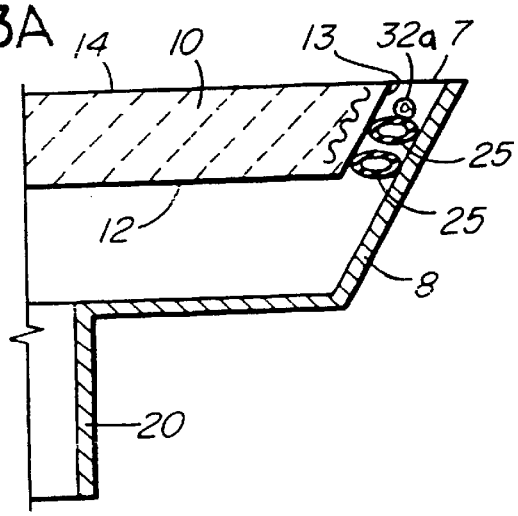
FIG. 5A is a schematic cross-section through another embodiment of the heating unit that uses a plurality of tubular resilient anchoring strips to locate the ceramic matrix within the heating unit frame and a tubular shield to protect the anchoring strips from heat degradation.
Figure 5:
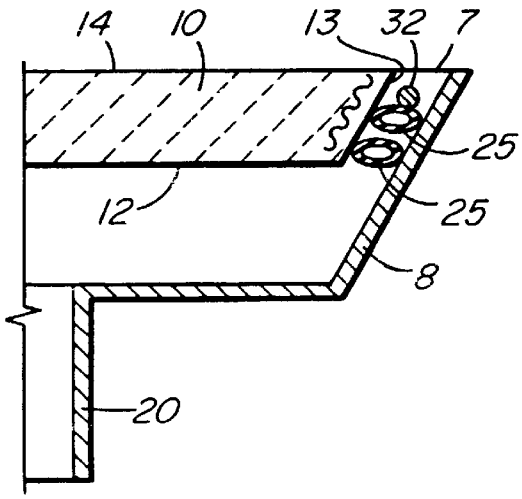
FIG. 5 is a schematic cross-section through a third embodiment of the heating unit that uses a plurality of tubular resilient anchoring strips to locate the ceramic matrix within the heating unit frame and a shield to protect the anchoring strips from heat degradation.
Figure 6:
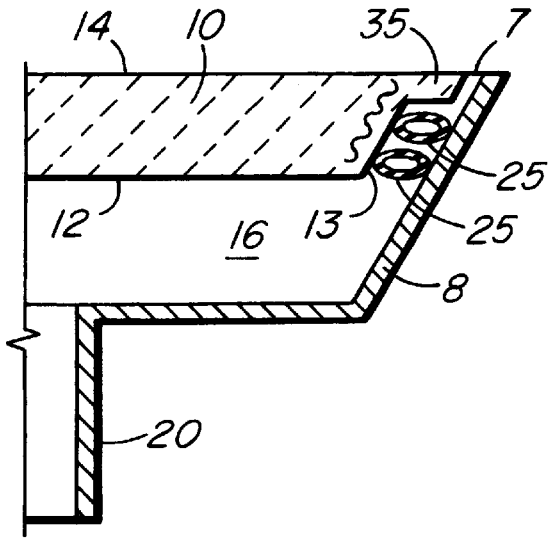
FIG. 6 is a schematic cross-section through a fourth embodiment of the heating unit that uses an alternative form of shield to protect the anchoring strips from heat degradation.

FIGS. 5 and 6 show still further embodiments of the heating unit of the present invention. In these units, a pair of resilient anchoring strips in the form of tubes 25 support the ceramic matrix 10 in frame 4. Two tubes provide increased resistance to displacement of the matrix from the frame by mechanical force and also serve to prevent tilt or rotational movement of the matrix. The dual tubes 25 offer increased mechanical stability of the ceramic matrix with the frame. The presence of a second tube also serves to prevent leakage of gases about the side walls of the matrix if one of the tubes were to fail or lose elasticity due to heating.

Silicone, when subjected to infrared radiation degrades to silica, which is white and therefore reflective. A white layer of silica prevents further degradation of the silicone member. In order to produce infrared emitters which survive for long periods (~3 years) in very hot environments, it is desirable to protect silicone members by providing a shield. To alleviate the problem of heat damage to the anchoring strips, the embodiments of FIGS. 5 and 6 also incorporate the feature of a shield adjacent the external surface to protect the strips. The shield is formed from a heat resistant insulating material.

Figure 7:
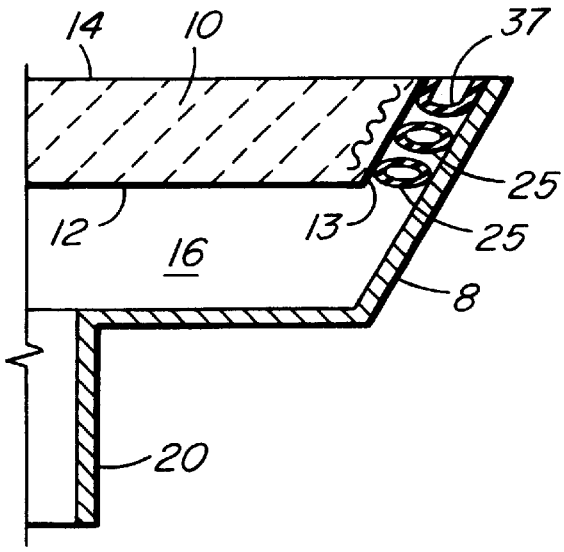
FIG. 7 is a schematic cross-section through a further embodiment of the heating unit that uses a further alternative form of shield to protect the anchoring strips from heat degradation.

For example, FIG. 5 shows a shield arrangement in which a cylindrical rope 32 of ceramic matrix is positioned on the outermost tube in the gap between the ceramic matrix and the frame side walls. Rope 32 is tacked into place on the outermost tube but it is not bonded to the ceramic matrix of the frame. Alternatively, a tube 32*a* of ceramic material can be used as illustrated in FIG. 5A. Other alternatives for a shield include refractory tapes or the like which occupy the gap between the ceramic matrix and the frame side walls over the anchoring strips. The approach here is to have a coverage element which does not contact firmly both the ceramic matrix and the metal frame so as to avoid fraying of the matrix during thermal cycling. Alternatively, as shown in FIG. 7, a flexible ceramic tape 37 may be anchored both to the ceramic matrix and the metallic frame with sufficient slack so as not to apply a tension force to the side wall of the ceramic matrix during heating expansion.

Figure 7A:
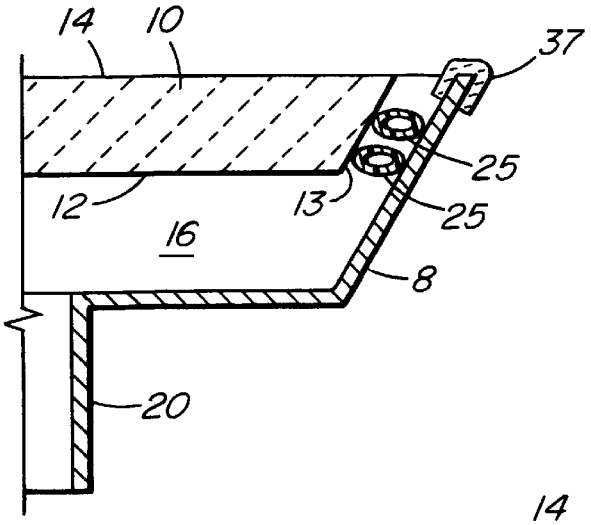
FIG. 7*a* shows another form of shield to protect the resilient member with the additional benefit of limiting the heat input to the housin.

Heat resistant insulating material in the form of ceramic woven material 40 can be applied over the top edge of the housing to extend downwardly along the inner surface of housing side wall 18 (FIG. 3). Ceramic material 40 acts to limit the heat input to the housing, thereby reducing the operating temperature of the frame and thermal expansion and contraction effects. It has been determined that ceramic material having a thickness of approximately ⅛ inch is sufficient to significantly reduce heating. Similarly, a ceramic tape of sufficient thickness to nearly fill the gap between the matrix and the housing edge may be used to wrap the housing edge. In the arrangement of FIG. 7*a*, the tape 37 functions to protect the silicone elastomer tubes 25 as well as limiting the heat input into the housing frame as described below.

FIG. 6 illustrates a shield arrangement comprising a flange 35 formed in the side walls of the ceramic matrix adjacent external surface 14. Preferably, flange 35 is integral with the ceramic matrix. The flange overlaps the outermost tube 25 and protects the tube from infrared radiation reflected back from objects being heated. The air/fuel mixture in chamber 16 can flow through the porous flange 35 and ignite at the external surface 14 of the flange to provide infrared heating effectively to the very edge of the frame 4.

The improved heating unit of the present invention is substantially immune to fraying of the edges of the ceramic matrix due to differential expansion forces. Prevention of fraying avoids the creation of holes and tears thereby eliminating the risk of explosion of the air/fuel mixture in the frame.

Figure 9:
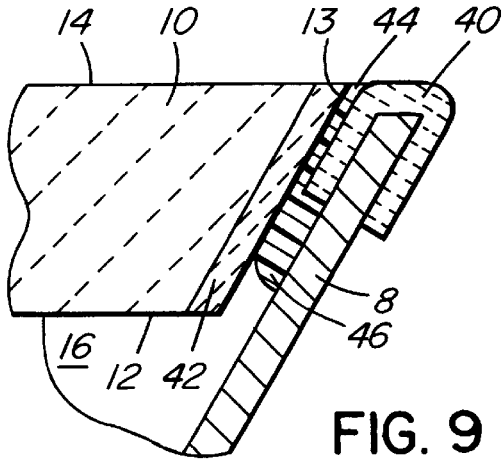
FIG. 9 is a detail view of the joint between the housing and the ceramic matrix in the heating unit of FIG. 8.
Figure 8:
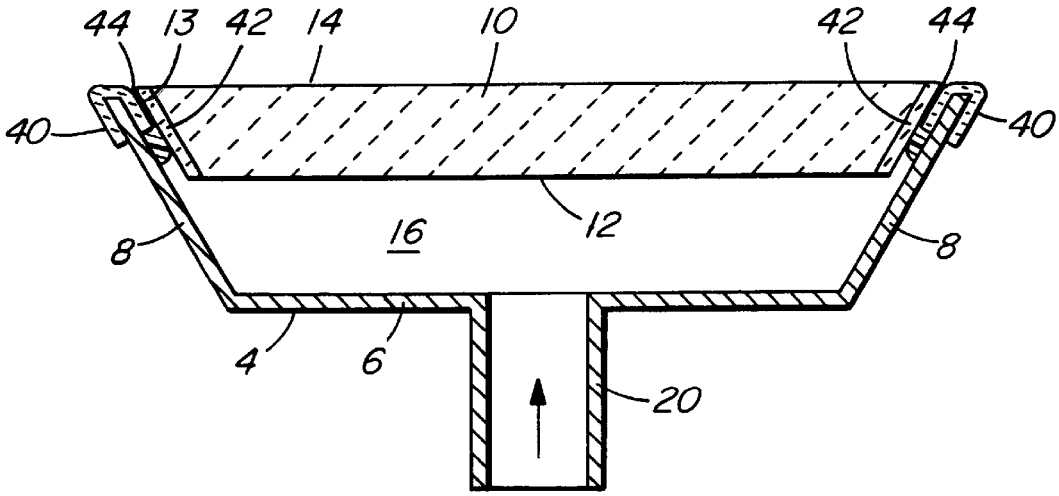
FIG. 8 is a schematic cross-section through a further embodiment of the heating unit according to the present invention which includes a blocking layer, a heat resistant insulating layer and an adhesive between the housing and the ceramic matrix.

FIGS. 8 and 9 show schematically in cross-section a further embodiment of the improved heating unit of the present invention. Parts that are identical to the parts of previous embodiments are labeled with the same reference numbers. In this arrangement, the edge of the ceramic matrix is sealed with a blocking agent 27 to prevent flame propagation from the external surface of the matrix to the side walls, and a heat resistant insulating layer is provided between the ceramic matrix and the housing to limit heat distribution to the housing and thereby thermal expansion of the housing.

The phenomenon of flame propagation from external surface 14 of the ceramic matrix 10 to side walls 13 of the matrix can occur in prior art heating unit designs (FIG. 1) if the silicone glue thickness 15 is sufficiently large. The glue does not serve to block the passage of the gas/air mixture through the side walls, and if the glue bond is sufficiently thick, the propagating flame is spaced apart from the metallic housing so as to defeat the housing's ability to quench the propagating flame by intimate contact. The heating unit of FIGS. 8 and 9 has been developed to address this problem. In the unit illustrated in cross-section in FIG. 8, ceramic matrix 10 includes a blocking layer 42 to seal side walls 13 of the matrix to prevent flow of the air/fuel mixture through the side walls. The presence of blocking layer 42 means that the ceramic matrix no longer has to rely on intimate contact with metal housing side walls 8 to quench flames and the thickness of the silicone glue bond is immaterial.

As previously described, blocking layer 42 is formed by applying a blocking agent 27 to the side walls of the ceramic matrix. The blocking agent 27 is preferably a thermosetting material applied to the side walls of the ceramic matrix to penetrate to a depth of at least about 2 mm. Preferably, the thermosetting material is applied in a molten state to impregnate the matrix side walls 13 and then hardened into a sealing layer. The hardening can be done in a heated hood. A preferred thermosetting material is epoxy resin, but other thermosetting materials can be used, such as polyesters or polyurethane. The thermosetting material must be able to penetrate the matrix side walls in a molten state and solidify to seal the pores of the ceramic matrix adjacent side walls 13. To make on-site spot repairs, the blocking agent 27 can be a solution of sodium silicate applied to a region on the side walls of the ceramic matrix to which the combustion flame is propagating.

A heat resistant insulating layer in the form of ceramic woven material 40 is positioned between the side walls 13 of the ceramic matrix and side walls 8 of the housing frame 4 to limit the heat transmitted to the frame by infrared reflection and thereby reduce the housing temperature and thermal expansion of the housing. Preferably, ceramic woven material 40 is in the form of an elongate tape that is folded over the top edge of housing side walls 8 to extend along the inner and outer surfaces of the side walls. Preferably, material 40 is folded in half and positioned to extend an equal distance along each surface. Material 40 is preferably affixed in place on the side walls by silicone glue. To ensure consistent placement of tape material 40, side walls 8 can be scribed to provide guidelines.

Ceramic matrix 10 with a sealed layer 42 at side walls 13 is retained within housing frame 4 by an adhesive layer 44 of silicone glue. Glue layer 44 impregnates and covers woven ceramic material 40 and extends below the material in region 46 (FIG. 9) over the bare metal of side walls 8.

When constructing a heater unit according to the present embodiment, ceramic woven material 40 is initially bonded in place on housing side walls 8. The sealed side walls 13 of ceramic matrix 10 are then coated with excess silicone glue. Additional glue is also applied to cover woven material 40 and region 46. The matrix is inverted so that external surface 14 is face down. The housing is also inverted and placed over the matrix and clamped in place to allow for curing of the silicone glue. The result is a heating unit having the construction illustrated in FIG. 8. The finished unit is fired to examine for gas leaks. Any excess silicone glue that has flowed onto matrix external surface 14 will burn away.

Figure 10:
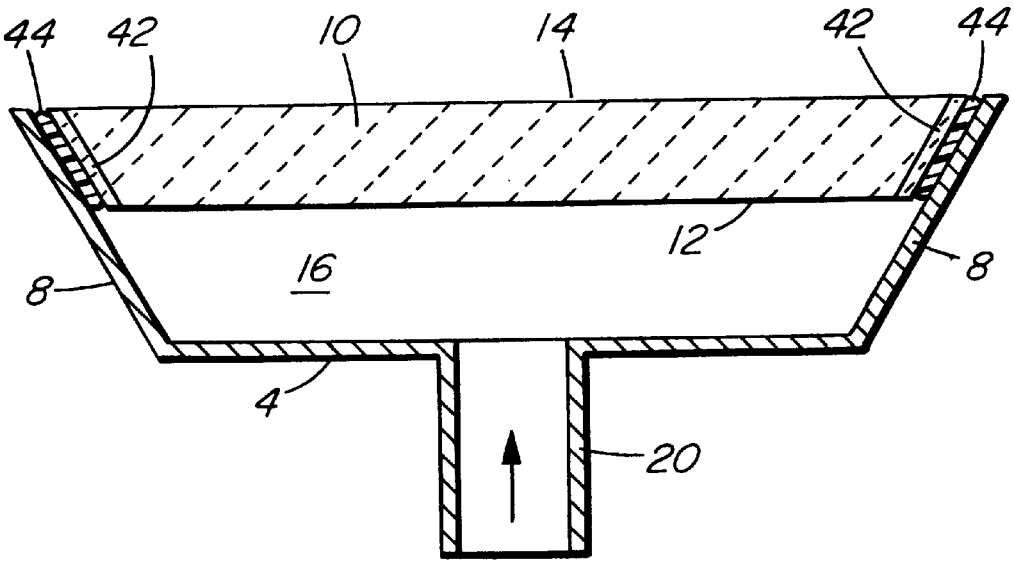
FIG. 10 is a schematic cross-section through a heating unit identical to that in FIG. 8 except for the absence of a heat resistant insulating layer.

FIG. 10 shows an alternative heating unit that is substantially identical to the unit of FIG. 8 except for the absence of heat resistant insulating material 40 between ceramic matrix 10 and side walls 8 of the housing. This embodiment addresses the problem of flame propagation through matrix side walls 13 by employing blocking layer 42 to prevent flow of the gas/air combustion mixture to the side walls. A layer of silicone glue 44 holds the ceramic matrix in place within the housing.

Figure 11:
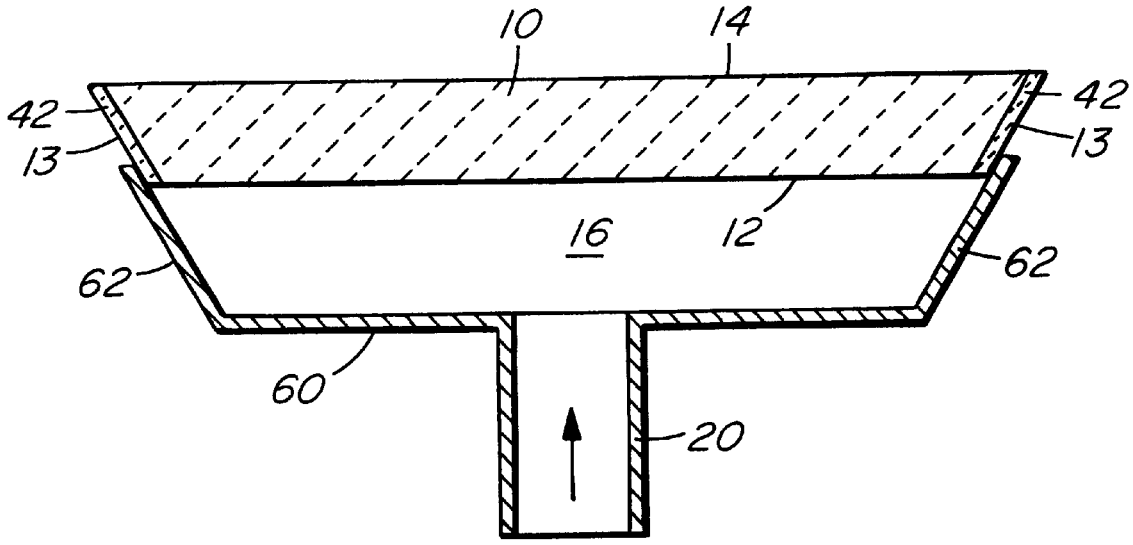
FIG. 11 is a schematic cross-section through another embodiment of a heating unit according to the present invention in which an upper ceramic matrix with exposed, sealed and blocked side walls is mounted atop a lower housing.

The heating unit of FIG. 11 is a further embodiment of the present invention that takes the approach of reducing or eliminating the side walls 13 of the ceramic matrix adjacent the side walls of the housing to minimize stresses due to differential expansion of the two parts. The heating unit of FIG. 11 includes a lower housing 60 atop which an upper ceramic matrix is mounted. Side walls 62 of housing 60 are short and do not substantially overlap with the side walls 13 of the ceramic matrix with the result that side walls 13 are exposed. The exposed matrix side walls are sealed by a blocking layer 42 as described in previous embodiments to avoid flame propagation problems. The ceramic matrix is preferably attached to the housing by silicone glue at the region of overlap.

Although the present invention has been described in some detail by way of example for purposes of clarity and understanding, it will be apparent that certain changes and modifications may be practised within the scope of the appended claims.

I claim:

1. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing about the side walls of the ceramic matrix to retain the ceramic matrix in place within the housing and form a seal about the side walls of the ceramic matrix, wherein the at least one resilient anchoring strip comprises a tube of resilient material; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

2. A heating unit as claimed in claim 1 in which the at least one resilient anchoring strip is formed from silicone.

3. A heating unit as claimed in claim 1 in which the housing comprises a metal frame having a back wall and side walls with the side walls of the ceramic matrix being received between the side walls of the metal frame.

4. A heating unit as claimed in claim 1 in which the side walls of the ceramic matrix are strengthened with a reinforcing material and the at least one resilient anchoring strip is bonded to the reinforcing material.

5. A heating unit as claimed in claim 4 in which the side walls of the ceramic matrix are impregnated with the reinforcing material.

6. A heating unit as claimed in 1 including a heat resistant material applied to the housing adjacent the at least one resilient strip to limit the heat transmitted to the housing.

7. A heating unit as claimed in claim 6 in which the heat resistant material is a ceramic woven material.

8. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing about the side walls of the ceramic matrix to retain the ceramic matrix in place within the housing and form a seal about the side walls of the ceramic matrix, wherein the at least one resilient anchoring strip is generally circular in cross-section; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

9. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing about the side walls of the ceramic matrix to retain the ceramic matrix in place within the housing and form a seal about the side walls of the ceramic matrix;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a shield positioned adjacent the external surface of the ceramic matrix to protect the at least one resilient anchoring strip from degradation by heat, and wherein the shield comprises a flange formed in the side walls of the ceramic matrix extending to cover the at least one resilient anchoring strip.

10. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing about the side walls of the ceramic matrix to retain the ceramic matrix in place within the housing and form a seal about the side walls of the ceramic matrix;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a shield positioned adjacent the external surface of the ceramic matrix to protect the at least one resilient anchoring strip from degradation by heat, and wherein the shield comprises a cylindrical member of ceramic matrix material mounted to the at least one resilient anchoring strip.

11. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing about the side walls of the ceramic matrix to retain the ceramic matrix in place within the housing and form a seal about the side walls of the ceramic matrix;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a shield positioned adjacent the external surface of the ceramic matrix to protect the at least one resilient anchoring strip from degradation by heat, and wherein the shield comprises a tubular member of ceramic matrix material mounted to the at least one resilient anchoring strip.

12. A heating unit comprising:

a housing;

a heat resistant, porous ceramic matrix received in the housing having an inner surface, side walls and an external surface, the inner surface of the ceramic matrix and the housing cooperating to define a chamber, and wherein the side walls of the porous ceramic matrix adjacent the at least one resilient anchoring strip are blocked with a blocking agent to prevent flow of the gas/air combustion mixture through the side walls, and wherein the blocking agent penetrates the side walls to a depth of at least about 2 mm;

at least one resilient anchoring strip extending between the ceramic matrix and the housing about the side walls of the ceramic matrix to retain the ceramic matrix in place within the housing and form a seal about the side walls of the ceramic matrix; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

13. A heating unit as claimed in claim 12 in which the blocking agent is a thermosetting material that forms a sealing layer.

14. A heating unit as claimed in claim 12 in which the blocking agent is a solution of sodium silicate applied to the side walls of the ceramic matrix.

15. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing;

a blocking agent to block the side walls of the porous ceramic matrix adjacent the at least one resilient anchoring strip to prevent flow of the gas/air combustion mixture through the side walls, wherein the blocking agent penetrates the side walls to a depth of at least about 2 mm; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

16. A heating unit as claimed in claim 15 in which the blocking agent is a thermosetting material that forms a sealing layer.

17. A heating unit as claimed in claim 15 in which the blocking agent is formed by applying a solution of sodium silicate to the side walls of the ceramic matrix.

18. A heating unit as claimed in claim 15 in which the at least one resilient anchoring strip is formed from silicone.

19. A heating unit as claimed in claim 15 in which the housing comprises a metal frame having a back wall and side walls with the side walls of the ceramic matrix being received between the side walls of the metal frame.

20. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing wherein the at least one resilient anchoring strip comprises a tube of resilient material;

a blocking agent to block the side walls of the porous ceramic matrix adjacent the at least one resilient anchoring strip to prevent flow of the gas/air combustion mixture through the side walls; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

21. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing wherein the at least one resilient anchoring strip is generally circular in cross-section;

a blocking agent to block the side walls of the porous ceramic matrix adjacent the at least one resilient anchoring strip to prevent flow of the gas/air combustion mixture through the side walls; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

22. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing wherein the at least one resilient anchoring strip is generally U-shaped in cross-section;

a blocking agent to block the side walls of the porous ceramic matrix adjacent the at least one resilient anchoring strip to prevent flow of the gas/air combustion mixture through the side walls; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

23. A heating unit comprising:

a housing;

a heat resistant, porous ceramic matrix received in the housing having an inner surface, side walls and an external surface, the inner surface of the ceramic matrix and the housing cooperating to define a chamber, and wherein the side walls of the ceramic matrix are strengthened with a reinforcing material;

at least one resilient anchoring strip bonded to the reinforcing material and extending between the ceramic matrix and the housing to retain and seal the ceramic matrix in place within the housing;

a blocking agent to block the side walls of the porous ceramic matrix adjacent the at least one resilient anchoring strip to prevent flow of the gas/air combustion mixture through the side walls; and an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating.

24. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing;

a blocking agent to block the side walls of the porous ceramic matrix adjacent the at least one resilient anchoring strip to prevent flow of the gas/air combustion mixture through the side walls;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a heat resistant material applied to the housing adjacent the at least one resilient strip to limit the heat transmitted to the housing.

25. A heating unit as claimed in claim 24 in which the heat resistant material is a ceramic woven material.

26. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing;

a blocking agent to block the side walls of the porous ceramic matrix adjacent the at least one resilient anchoring strip to prevent flow of the gas/air combustion mixture through the side walls;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a shield positioned adjacent the external surface of the ceramic matrix to protect the at least one resilient anchoring strip from degradation by heat, wherein the shield comprises a flange formed in the side walls of the ceramic matrix extending to cover the at least one resilient anchoring strip.

27. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing;

a blocking agent to block the side walls of the porous ceramic matrix adjacent the at least one resilient anchoring strip to prevent flow of the gas/air combustion mixture through the side walls;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a shield positioned adjacent the external surface of the ceramic matrix to protect the at least one resilient anchoring strip from degradation by heat, wherein the shield comprises a cylindrical member of ceramic matrix material mounted to the at least one resilient anchoring strip.

28. A heating unit comprising:

a housing;

a heat resistant, porous ceramic matrix received in the housing having an inner surface, side walls and an external surface, the inner surface of the ceramic matrix and the housing cooperating to define a chamber;

at least one resilient anchoring strip extending between the ceramic matrix and the housing to retain and seal the ceramic matrix in place within the housing;

a blocking agent to block the side walls of the porous ceramic matrix adjacent the at least one resilient anchoring strip to prevent flow of the gas/air combustion mixture through the side walls;

an inlet to the housing to admit a gas/air combustion mixture to the chamber whereby the gas/air mixture passes through the ceramic matrix to burn adjacent the external surface of the ceramic matrix to heat the external surface with the resilient anchoring strip being adapted to expand or contract to accommodate relative movement of the ceramic matrix with respect to the housing due to heating; and a shield positioned adjacent the external surface of the ceramic matrix to protect the at least one resilient anchoring strip from degradation by heat, wherein the shield comprises a tubular member of ceramic matrix material mounted to the at least resilient anchoring strip.

29. A heating unit as claimed in claim 28 in which the blocking agent is a solution of sodium silicate applied to the side walls of the ceramic matrix.

30. A heating unit comprising:

a housing;

a heat resistant, porous ceramic matrix received in the housing having an inner surface, side walls and an external surface;

a blocking layer formed by applying a blocking agent to the side walls of the ceramic matrix to block the side walls of the porous ceramic matrix to prevent flow of a gas/air combustion mixture through the side walls, wherein the blocking agent is a thermosetting material applied to the side walls of the ceramic matrix to penetrate to a depth of at least about 2 mm;

an adhesive layer between the housing and the side walls of the ceramic matrix to retain the matrix within the housing, the inner surface of the ceramic matrix and the housing cooperating to define a chamber; and an inlet to the housing to admit the gas/air combustion mixture to the chamber whereby the gas/air mixture passes through the ceramic matrix to burn adjacent the external surface of the ceramic matrix to heat the external surface.

31. A heating unit as claimed in claim 30 in which the thermosetting material is epoxy resin.

32. A heating unit comprising:

a housing;

a heat resistant, porous ceramic matrix received in the housing having an inner surface, side walls and an external surface;

a blocking layer to block the side walls of the porous ceramic matrix to prevent flow of a gas/air combustion mixture through the side walls;

an adhesive layer comprising silicone glue between the housing and the side walls of the ceramic matrix to retain the matrix within the housing, the inner surface of the ceramic matrix and the housing cooperating to define a chamber; and an inlet to the housing to admit the gas/air combustion mixture to the chamber whereby the gas/air mixture passes through the ceramic matrix to burn adjacent the external surface of the ceramic matrix to heat the external surface.

33. A heating unit comprising:

a lower housing having an inlet to admit a gas/air combustion mixture;

a heat resistant, upper porous ceramic matrix having an inner surface, an external surface and blocked side walls, the ceramic matrix being mounted atop the lower housing and attached thereto by silicone glue such that the blocked side walls of the matrix are exposed and the inner surface of the ceramic matrix and the housing cooperate to define a chamber to receive the gas/air combustion mixture;

whereby the gas/air mixture passes through the ceramic matrix to burn adjacent the external surface of the ceramic matrix to heat the external surface, and the blocked side walls prevent flow of the gas/air combustion mixture through the side walls.

34. A heating unit comprising:

a lower housing having an inlet to admit a gas/air combustion mixture;

a heat resistant, upper porous ceramic matrix having an inner surface, an external surface and blocked side walls including a blocking layer formed by applying a blocking agent to the side walls of the ceramic matrix, said blocking agent being a thermosetting material applied to the side walls of the ceramic matrix to penetrate to a depth of at least about 2 mm, the ceramic matrix being mounted atop the lower housing such that the blocked side walls of the matrix are exposed and the inner surface of the ceramic matrix and the housing cooperate to define a chamber to receive the gas/air combustion mixture; and whereby the gas/air mixture passes through the ceramic matrix to burn adjacent the external surface of the ceramic matrix to heat the external surface, and the blocked side walls prevent flow of the gas/air combustion mixture through the side walls.

* * * * *